US006047635A

United States Patent [19]

Hardy

[11] Patent Number: 6,047,635

[45] Date of Patent: Apr. 11, 2000

[54] APPARATUS FOR RANDOMLY MARKING A GAME CARD

[76] Inventor: William Henry Hardy, 30 Edward Mews, Islington Park Street, London N11SG, United Kingdom

[21] Appl. No.: 09/063,018

[22] Filed: Apr. 20, 1998

[30] Foreign Application Priority Data

Apr. 21, 1997 [GB] United Kingdom ..... 9708015
Sep. 8, 1997 [GB] United Kingdom ..... 9719070

[51] Int. Cl.[7] ..... B41K 47/10

[52] U.S. Cl. ..... 101/69; 101/66; 101/333

[58] Field of Search ..... 101/69, 70, 103, 101/333, 66, 93, 93.37, 368, 372

[56] References Cited

U.S. PATENT DOCUMENTS

| | | | |
|---|---|---|---|
| 2,673,518 | 3/1954 | Ardizzone | 101/372 |
| 3,477,715 | 11/1969 | Nekton | 101/368 X |
| 3,703,293 | 11/1972 | Nekton | 101/103 X |
| 4,444,394 | 4/1984 | Pasquine | 273/144 B |
| 4,875,411 | 10/1989 | Turner | 101/333 |
| 4,998,473 | 3/1991 | Laureyns | 101/333 |

*Primary Examiner*—Ren Yan
*Assistant Examiner*—Minh H. Chau
*Attorney, Agent, or Firm*—Hodgson, Russ, Andrews, Woods & Goodyear LLP

[57] ABSTRACT

Apparatus for randomly marking a game card comprises an array of marking means (46, 48) independently moveable within respective apertures (40) from a stowed position to a deployed position to mark a game card, a plurality of balls (62), the number of which is less than the number of marking means, each ball being capable of entering wholly a randomly selected one of the apertures, and means (64) for engaging each ball when located in its respective aperture to move its related marking means from the stowed position to the deployed position.

19 Claims, 3 Drawing Sheets

APPARATUS FOR RANDOMLY MARKING A GAME CARD

This invention relates to apparatus for randomly marking a game card, such as a lottery card, pools coupon, "spot the ball" picture or such like, and in particular to an ink printer for randomly marking a game card.

In a first aspect, the present invention provides apparatus for randomly marking a game card, said apparatus comprising:

an array of marking means independently moveable within respective apertures from a stowed position to a deployed position to mark a game card;

a plurality of balls, the number of which is less than the number of marking means, each ball being capable of entering wholly a randomly selected one of said apertures; and means for engaging each said ball when located in its respective aperture to move its related marking means from said stowed position to said deployed position.

The term "array" used herein is not limited to an arrangement definable in terms of both rows and columns, but extends to a single row, a single column and a random arrangement.

Preferably the apertures are arranged in a plurality of rows, adjacent rows being separated by a ridge.

In a second aspect, the present invention provides apparatus for randomly marking a game card, said apparatus comprising:

an array of marking means independently moveable within respective apertures from a stowed position to a deployed position to mark a game card, said apertures being arranged in a plurality of rows, adjacent rows being separated by a ridge, a plurality of balls, the number of which is less than the number of marking means, each ball being capable of entering a randomly selected one of said apertures; and means for engaging each said ball when located in its respective aperture to move its related marking means from said stowed position to said deployed position.

Preferably, each of the balls is capable of entering wholly a randomly selected one of said apertures.

Each marking means may comprise a rod and a marking element attached to the end of the rod remote from the engaging means. The marking element may comprise an inked pad.

Preferably, the ball engaging-means comprise pins arranged coaxially with respective apertures and axially movable relative to said apertures.

In a preferred embodiment, the apparatus further comprises:

a first frame having mounted therein in parallel relationship an array of tubular apertures each having located therein a marking means independently axially slidable therein from a stowed position to a deployed position to mark a game card, each marking means having a marking element at one end;

a second frame having mounted therein a number of pins each aligned with and axially spaced from a respective tubular aperture;

said first and second frames being spaced apart to form therebetween a closed housing in which are located a plurality of balls, the number of balls being less than the number of tubular apertures and each ball being capable of entering a randomly selected one of the tubular apertures and engaging the end of a marking means remote from the marking element; and means for effecting relative movement of the second frame and the first frame to cause the pins to enter their respective apertures whereby the pins engage balls in the randomly selected tubular apertures and move the marking elements in said randomly selected apertures to the deployed position.

In a second aspect, the present invention provides a combination of apparatus for randomly marking a game card as hereinbefore described and means for aligning said apparatus with a game card.

The aligning means may comprise a slot within which a game card is removably locatable, said slot including an open face to expose a game card located in said slot and means for removably locating said apparatus on said slot in alignment with a game card located in said slot.

Said apparatus may be removably locatable in a set of recesses formed in said slot. The slot may include a plurality of sets of recesses spaced along said slot.

Preferred embodiments will now be described, purely by way of example, and with reference to the accompanying drawings which the invention is embodied in an ink printer, and in which.

Figure 1:
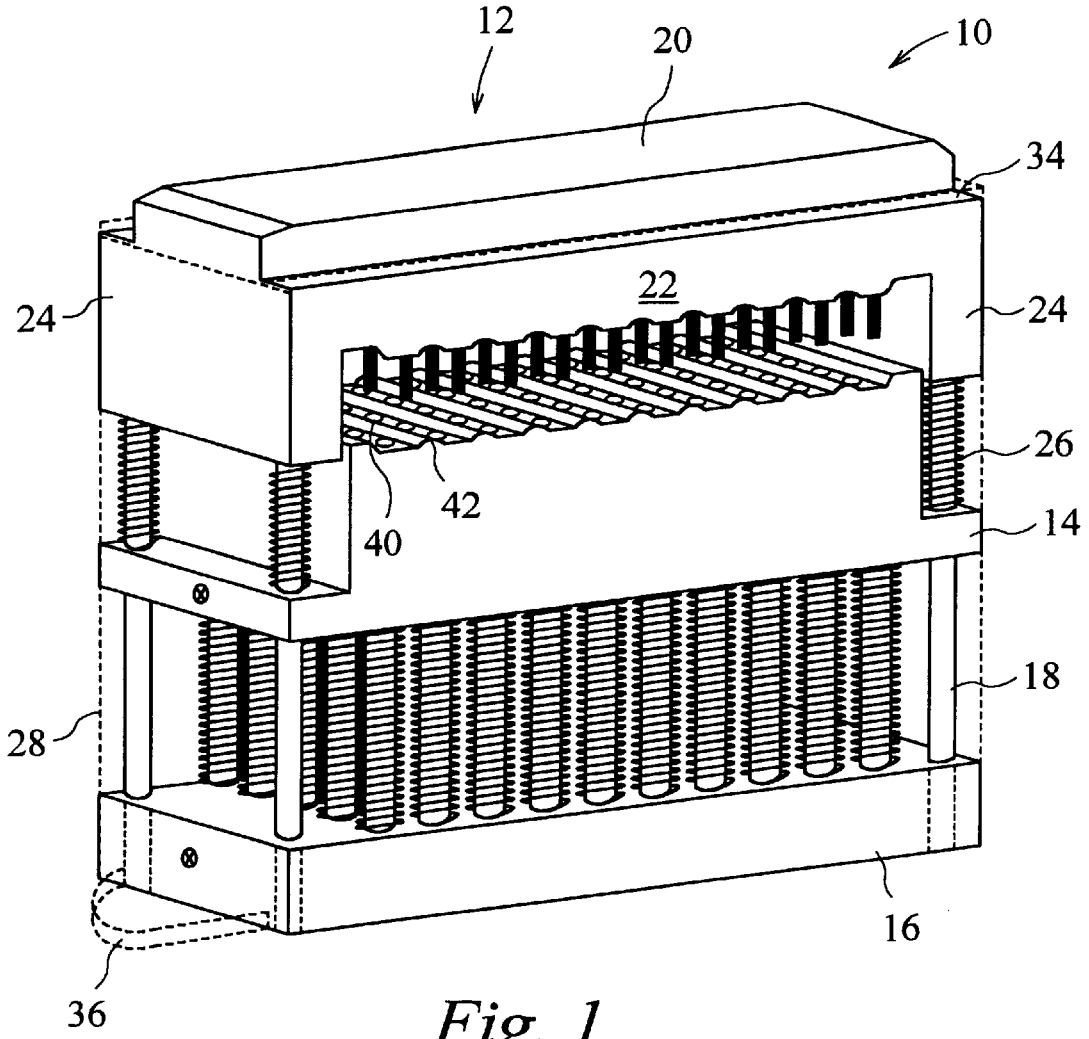
FIG. 1 shows a perspective view of an ink printer.

Referring first in particular to FIG. 1, an ink printer 10 comprises a depressible frame 12, body frame 14 and bottom plate 16. The body frame 14 is attached to and spaced from the bottom plate 16 by means of four shafts 18 which pass through apertures formed in the body frame 14 and bottom plate 16, both the body frame 14 and the bottom plate 16 being rigidly attached to the shafts 18. The shafts 18 extend upwardly beyond the apertures in the body frame 14 for a purpose described below.

The depressible frame 12 comprises a body 22 having two downwardly extending end walls 24. The body 22 includes an upwardly projecting section 20. The depressible frame 12 is located over and spaced from the body frame 14 by four compressible springs 26, each of which is mounted on an extension of the respective shaft 18 which projects above the apertures in the body frame 12. Each end wall 24 includes a pair of recesses, each shaft 18 being a sliding fit in a respective recess.

The depressible frame 12, body frame 14 and bottom plate 16 are surrounded by a cover 28 which is a sliding fit over frame 12, body frame 14 and bottom plate 16. The cover is formed preferably from rigid, transparent material, such as perspex. The cover 28 is open at both the upper end 30 and the bottom end 32 thereof. The upper end 30 of the cover 28 is formed with a pair of shoulders 34. Under the action of the springs 26, the depressible frame is forced towards the upper end 30 of the cover 28, the shoulders 34 retaining the body 22 within the cover 28 with the upwardly projecting section 20 extending proud of the cover 28.

Figure 4:
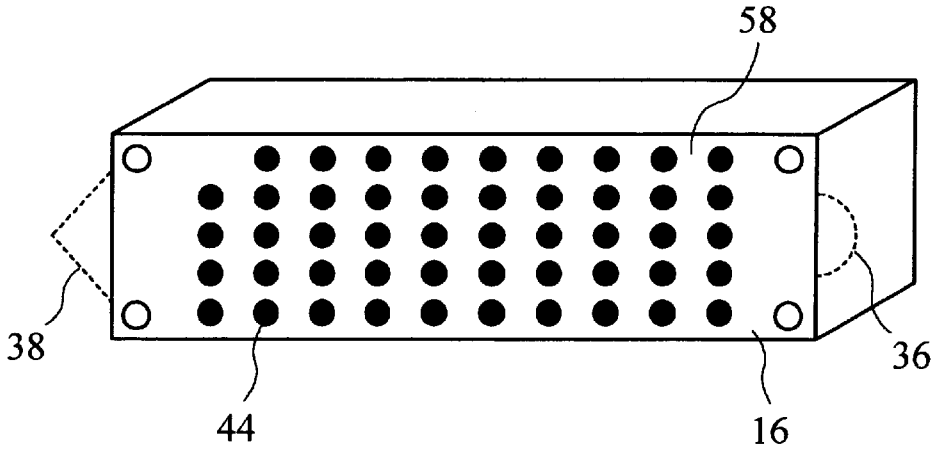
FIG. 4 is a bottom view of the bottom face of the ink printer of FIG. 1.

The bottom end 32 of the cover 28 includes two alignment members 36 and 38 projecting from opposed side walls of the cover. The alignment members have different shapes; as shown in FIG. 4 alignment member 36 is semicircular and alignment member 38 is triangular.

An array of vertically extending cylindrical apertures 40 is formed in the body frame 14. In this preferred embodiment, the apertures are arranged in rows, adjacent rows being separated by a ridge 42 formed in the upper surface of the body frame 14. A similar array of apertures 44 is formed in the bottom plate 16, the arrays of apertures 40 and 44 being aligned-so that each of the apertures 40 is coaxial with one of the apertures 44. With reference to FIG. 4, in this preferred embodiment each array comprises 49 apertures, although the present invention is not limited to this number of apertures.

A rod 46 is axially slidably disposed within each of the apertures 40. In this preferred embodiment, the rods are tubular. Each rod 46 extends from the bottom of the aperture 40 and enters the aperture 44 coaxially aligned with that aperture 40.

A marking element 48 as attached to the bottom end of each rod 46. In the preferred embodiment, a lower portion 50 of each marking element 48 comprises an ink-absorbent pad formed, for example, from felt or cotton. An upper portion 52 of the marking element 48 extends within the bore of the rod 46, and is of sufficient length to retain enough ink for marking a number of game cards without the need to replenish the supply of ink in the marking element 48.

A collar 54 extends circumferentially around each rod 46. The collar 54 may be integral with the rod 46, or may be a separate element attached to the rod. The collar 54 is located towards the upper end of the portion of the rod 46 extending between the body frame 14 and the bottom plate 16. A compressible spring 56 is located around each rod 46. The upper end of the spring 56 abuts the lower surface of the collar 54 and the lower end of the spring 56 abuts the upper surface of the bottom plate 16. As shown in FIG. 1, the springs 56 are biased to force the upper surface of the collar 54 against the lower surface of the body frame 14. In this first, stowed position of the marking elements 48, the lower surface of each ink-absorbent pad 50 is substantially planar with the lower surface 58 of the bottom plate. Alternatively, in this stowed position the lower surface of each ink-absorbent pad may be retracted within the bottom plate 16 and spaced From the plane of the lower surface 58 of the bottom plate 16.

A housing 60 for balls 62 is defined by cover 28, the lower surface of the body 22, the internal faces of the end walls 24, the upper surface of body frame 14 and the upper end surfaces of the rods 46. The balls may be ball bearings or similar, substantially incompressible spheres. The diameter of the balls 62 is larger than the diameter of the bore of the rods 46 and smaller than the diameter of the apertures 40, and is selected so that the balls will not become immovably wedged within the bore of a rod.

The number of balls 62 is less than the number of marking elements 48 and is equal to the number of markings to be made on a game card. In this preferred embodiment, the apparatus includes six balls 62. In the stowed position of the marking elements 48 shown in FIG. 2, the upper ends of the rods 46 are sufficiently spaced from the upper surfaces of the ridges 42 to enable each of the balls 62 to enter wholly a respective aperture 40.

An array of pins 64 is attached to the lower surface of the body portion 22 of the depressible frame 12, the pins extending within the housing 60 towards the array of apertures 40. The number of pins 64 is equal to the number of apertures 40, and each pin is coaxially aligned with a respective aperture 40. The diameter of the pins 64 is less than the diameter of the bore of the rods 46. As shown in FIG. 1, the lower surface of the body portion of the depressible frame 12 is formed with an array of grooves extending between the rows of the pins 64 to accommodate the ridges 40 formed in the upper surface of the body frame 14.

Figure 5:
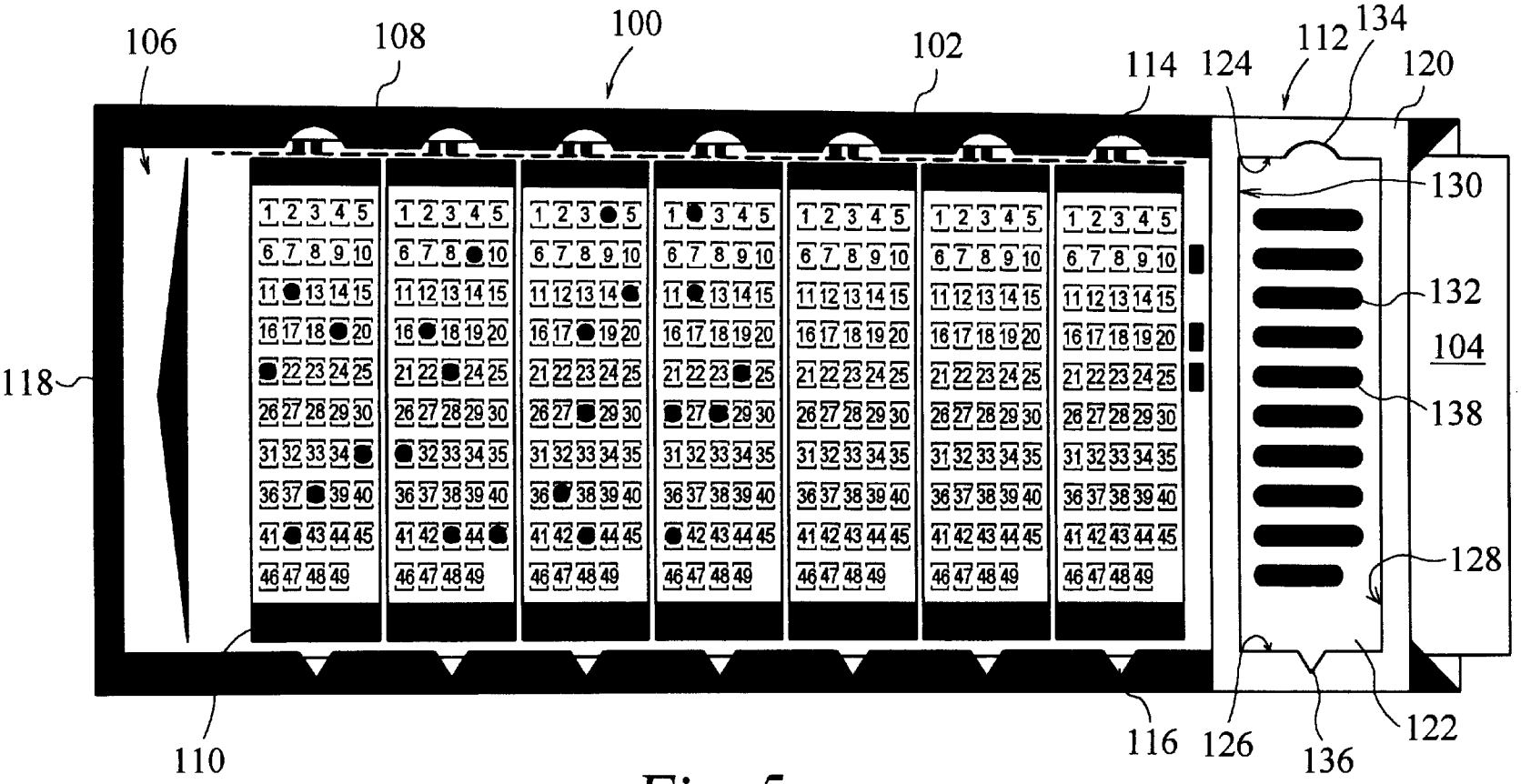
FIG. 5 shows a holder for a game card, with a game card in situ.

The printer 10 may be used in association with a holder for a game card. Such a holder is shown in FIG. 5, generally designated by the reference numeral 100. The holder 100 comprises a slot 102 into which a game card, shown in FIG. 5 as a lottery card 104, is removably insertable. An open face 106 is formed in the upper surface 108 of the slot 102 so that grids of numbers 110 on the lottery card 104 remain exposed when the lottery card 104 is inserted into the slot 102.

The printer is removably insertable into notches 114, 116 formed in the upper surface 108 of the slot 102. As shown in FIG. 5, these notches 114, 116 have different shapes, the shape of the notches 114, 116 conforming to that of the alignment members 36, 38 formed on the bottom end of the cover in order to ensure that the printer is correctly oriented with respect to a game card inserted in the slot. The spacing of the notches 114, 116 along the length of the slot 102 is such that, when the lottery card 104 is fully slotted into the slot, so that the left-hand side of the lottery card 104 abuts the side wall 118 of the slot 102, the printer 10 will be located so that each marking element 48 of the printer 10 will be in alignment with a respective number in a grid of numbers 110 on the lottery card 104.

In operation, the printer 10 is first shaken by the user to distribute randomly the balls 62 within the housing 60. When the shaking stops, the balls 62 come to rest in respective apertures 40. The cover 28 may be formed from transparent material, such as plastics material, in order for the user to check that all of the balls 62 have come to rest in an aperture 40; if not, the printer 10 may be shaken again.

The inventor has found that by forming the mouths of the apertures 40 in depressions in the upper surface of the body frame 14, in this preferred embodiment by providing ridges 42 between the rows of apertures 40, the distribution of the balls 62 among the apertures 40 is more random than in arrangements in which the lower surface of the housing 60 is substantially flat, in which case the inventor has found that the balls 62 tend to be distributed along the side walls of the housing 60. Moreover, the ridges reduce the risk of balls jamming the mouth of an aperture.

With a lottery card 104 inserted in the slot 102, the printer 10 is placed on the game card, the alignment members 36 and 38 entering the respective notches 114 and 116 formed in the slot 102.

Figure 2:
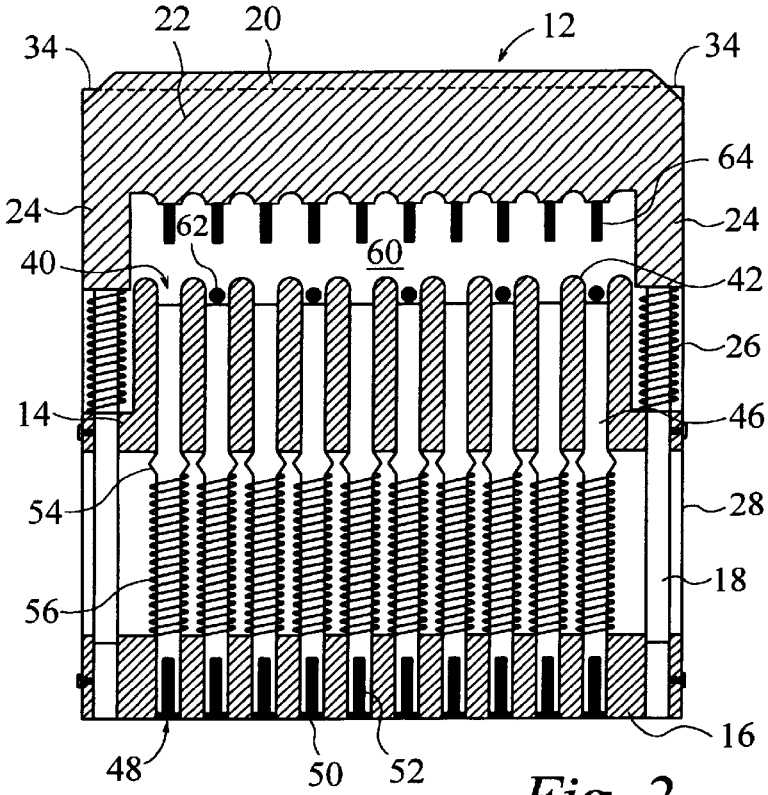
FIG. 2 shows a cross-section of the ink printer of FIG. 1 with marking elements in a stowed position.
Figure 3:
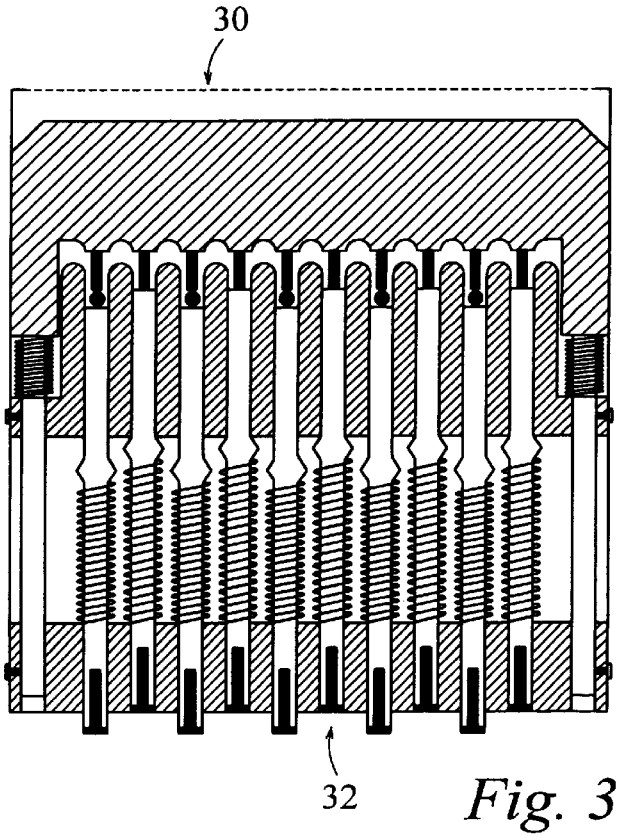
FIG. 3 shows the ink printer of FIG. 1 with a number of the marking elements in a deployed position.

The user of the printer then depresses the upwardly extending section 20 of the depressible frame 12 downwards from the position shown in FIG. 2 towards a second, fully depressed position as shown in FIG. 3. As the depressible frame 12 moves towards the body frame 14, compressing the springs 26, six of the pins 64 engage respective balls 62 and cause them to move further into the aperture 40 and in turn move the six rods 46 upon which the balls 62 are located from their stowed position, compressing the springs 56 located around those rods.

Sufficient depression of the depressible frame 12 causes the marking elements 48 attached to those rods 46 to contact the lottery card 104, thereby producing a set of markings on the lottery card 104. Only those rods 46 upon which the balls 62 are located move towards the lottery card 104. With respect to the remaining rods 46, the pins 64 do not contact these rods as the depressible frame 12 is moved towards its fully depressed position; either the pins 64 do not reach the upper surface of the rods 46 when the depressible frame is fully depressed or, as shown in FIG. 3, the pins 64 enter the bores of the rods 46 without contacting the rods 46.

FIG. 3 shows the fully depressed position of the depressible frame 12, in which the rods 46 upon which the balls 62 are located are in their fully deployed position. Movement of the depressible frame 12 towards the body frame 14 is limited either by the depth of the recesses formed in the side portions 24 of the frame 12 or by the springs 26.

When pressure is removed from the frame 12, springs 26 expand, forcing the frame 12 away from the body frame 14. Similarly, as the pins 64 disengage the balls 62, the springs 56 located around the deployed rods 46 expand, forcing the marking element 48 from the deployed position shown in FIG. 3 to the stowed position shown in FIG. 2.

Depending on whether the user wishes to re-use the printer 10 to mark another grid of numbers 110 on the lottery card 104, the printer 10 may be disengaged from the slot 102 to be inserted into another set of recesses 114, 116 formed in the slot 102. The printer 10 is then shaken by the user to move the balls 62 into another random arrangement in the apertures 40, and the process described above repeated in order to produce another set of markings on the lottery card 104.

The invention has been described above with respect to an ink printer. However, the apparatus may comprise alternative means for marking a game card, such as a sharp point located at the end of each of the rods 46 for creating a physical impression on the surface of the game card. This would be advantageous when only a small mark is desired, for example, when the apparatus is used to mark the surface of the "spot the ball" game card.

In another variation, an inking device may be provided to transfer ink to the marking elements 48, thereby avoiding the possibility that any of the marking elements may "dry up" and not mark the game card 104. Such an inking device 112 is shown in FIG. 5.

The inking device 112 comprises a floor 122, side walls 124, 126, 128 and 130 and inked pad 138. Rows of slots 132 are formed in the floor 122 of the inking device 112 in order to expose the inked pad 138. In order to ensure that the printer 10 is correctly oriented within the device 112, notches 134 and 136 are formed in opposing side walls 124 and 126 of the device 112 and shaped so as to receive respectively the alignment members 36 and 38 on the side walls of the cover 28 of the printer 10.

In order to transfer ink to the marking elements 48, the printer is first shaken by the user to distribute randomly the balls 62 within the housing 60, as described above. Before placing the printer 10 in the slot 102, the printer 10 is placed on the floor 122 of the inking device 112 and located in place by the side walls 124, 126, 128 and 130 and the notches 134 and 136. The user then depresses upwardly extending section 20 of the depressible frame 12 downwards so that the six rods 46 upon which the balls 62 are located move from their stored position and pass through the slots 132 formed in the floor 122 of the inking device 112 to contact the inked pad 138, thereby inking the marking elements 48 of these six rods 46. The user then removes pressure from the frame 12 so that the marking elements 48 move to their stored position, and, without moving the balls 62, places the printer 10 in the desired position in the slot 102 and again depresses the frame 12 so that the six inked marking elements 48 contact the game card 104 located in the slot 102.

It is also not necessary for the alignment members 36, 38 to take different shapes. The alignment members may have the same shape, for example, the alignment members may comprise a pair of screws fastened to the cover 28, and the outer walls of the printer 10 may include indicia to indicate the correct orientation of the printer 10 with respect to a game card located in the slot. Preferably, the indicia comprise raised markings formed on the outer walls of the cover 28 to enable a blind person to locate correctly the printer 10 on the slot 102.

Each feature disclosed in the description, and (where appropriate) the claims and drawings may be provided independently or in any appropriate combination.

What is claimed is:

1. Apparatus for randomly marking a game card, said apparatus comprising:

a body in which an array of apertures is formed;

an array of markers independently moveable within respective ones of said apertures from a stowed position to a deployed position to mark a game card;

a plurality of balls, the number of which is less than the number of markers, each ball being capable of entering wholly a randomly selected one of said apertures; and a plurality of pins, each pin being arranged coaxially with a respective aperture and axially movable relative to said aperture to engage a said ball when located in the respective aperture to move its related marker from said stowed position to said deployed position.

2. Apparatus according to claim 1, wherein said apertures are arranged in rows, adjacent rows being separated by a ridge formed in said body.

3. Apparatus according to claim 1, wherein each marking means comprises a rod and a marking element attached to the end of the rod remote from the engaging means.

4. Apparatus according to claim 3, wherein the marking element comprises an ink pad.

5. Apparatus according to claim 1, said apparatus comprising:

a first frame having mounted therein in parallel relationship an array of tubular apertures each having located therein a marking means independently axially slidable therein from a stowed position to a deployed position to mark a game card, each marking means having a marking element at one end;

a second frame having mounted therein a number of pins each aligned with and axially spaced from a respective tubular aperture;

said first and second frames being spaced apart to form therebetween a closed housing in which are located a plurality of balls, the number of balls being less than the number of tubular apertures and each ball being capable of entering wholly a randomly selected one of the tubular apertures and engaging the end of a marking means remote from the marking element; and means for effecting relative movement of the second frame and the first frame to cause the pins to enter their respective apertures whereby the pins engage balls in the randomly selected tubular apertures and move the marking elements in said randomly selected apertures to the deployed position.

6. Apparatus according to claim 2, wherein each of said balls is capable of entering wholly a randomly selected one of said apertures.

7. Apparatus according to claim 2, wherein each marker comprises a rod and a marking element attached to the end of the rod remote from the pin.

8. Apparatus according to claim 7, wherein the marking element comprises an ink pad.

9. Apparatus according to claim 2, said apparatus comprising:

a first frame having mounted therein in parallel relationship an array of tubular said apertures each having located therein a said marker independently axially slidable therein from a stowed position to a deployed position to mark a game card, each marker having a marking element at one end;

a second frame having mounted therein a number of said pins each aligned with and axially spaced from a respective tubular aperture;

said first and second frames being spaced apart to form therebetween a closed housing in which are located said balls, the number of balls being less than the number of tubular apertures and each ball being capable of entering wholly a randomly selected one of the tubular apertures and engaging the end of a said marker remote from the marking element; and guides permitting relative movement of the second frame and the first frame to cause the pins to enter their respective apertures whereby the pins engage balls in the randomly selected tubular apertures and move the marking elements in said randomly selected apertures to the deployed position.

10. In combination, apparatus for randomly marking a game card according to claim 1 and a device for aligning said apparatus with said game card.

11. A combination according to claim 10, wherein said aligning device comprises a slot within which a game card is removably locatable, said slot including an open face to expose a game card located in said slot and locating elements for removably locating said apparatus on said slot in alignment with a game card located in said slot.

12. In combination, apparatus for randomly marking a game card according to claim 2 and a device for aligning said apparatus with said game card.

13. A combination according to claim 12, wherein said aligning device comprises a slot within which a game card is removably locatable, said slot including an open face to expose a game card located in said slot and locating elements for removably locating said apparatus on said slot in alignment with a game card located in said slot.

14. In combination, apparatus for randomly marking a game card, and a device for aligning said apparatus with a game card, said apparatus comprising:

an array of markers independently moveable within respective apertures from a stowed position to a deployed position to mark a game card;

a plurality of balls, the number of which is less than the number of markers, each ball being capable of entering wholly a randomly selected one of said apertures; and a respective engaging device for engaging each said ball when located in its respective aperture to move its related marker from said stowed position to said deployed position, the aligning device comprising a slot within which a game card is removably locatable, said slot including an open face to expose a game card located in said slot and locating elements for removably locating said apparatus on said slot in alignment with a game card located in said slot.

15. A combination according to claim 14, wherein said elements are a set of recesses formed in said slot.

16. A combination according to claim 15, wherein said slot includes a plurality of said sets of recesses spaced along said slot.

17. In combination, apparatus for randomly marking a game card and a device for aligning said apparatus with a game card, said apparatus comprising:

an array of markers independently moveable within respective apertures from a stowed position to a deployed position to mark a game card, said apertures being arranged in a plurality of rows, adjacent rows being separated by a ridge;

a plurality of balls, the number of which is less than the number of markers, each ball being capable of entering a randomly selected one of said apertures; and a respective engaging device for engaging each said ball when located in its respective aperture to move its related marker from said stowed position to said deployed position, the aligning device comprising a slot within which a game card is removably locatable, said slot including an open face to expose a game card located in said slot and locating elements for removably locating said apparatus on said slot in alignment with a game card located in said slot.

18. A combination according to claim 17, wherein said locating elements are a set of recesses formed in said slot.

19. A combination according to claim 18, wherein said slot includes a plurality of said sets of recesses spaced along said slot.

* * * * *